US009356330B1

(12) United States Patent
Donoghue et al.

(10) Patent No.: US 9,356,330 B1
(45) Date of Patent: May 31, 2016

(54) RADIO FREQUENCY (RF) COUPLERS

(71) Applicants: Daniel Donoghue, Tewksbury, MA (US); Eric Gray, Westford, MA (US); Abid Hussain, Newbury (GB); Duncan Little, Tyngsboro, MA (US); Valter Karavanic, Nashua, NH (US)

(72) Inventors: Daniel Donoghue, Tewksbury, MA (US); Eric Gray, Westford, MA (US); Abid Hussain, Newbury (GB); Duncan Little, Tyngsboro, MA (US); Valter Karavanic, Nashua, NH (US)

(73) Assignee: ANADIGICS, INC., Warren, NJ (US)

( * ) Notice: Subject to any disclaimer, the term of this patent is extended or adjusted under 35 U.S.C. 154(b) by 138 days.

(21) Appl. No.: 14/026,461

(22) Filed: Sep. 13, 2013

Related U.S. Application Data

(60) Provisional application No. 61/701,168, filed on Sep. 14, 2012.

(51) Int. Cl.
*H01P 5/18* (2006.01)
*H01P 3/08* (2006.01)

(52) U.S. Cl.
CPC ..... *H01P 3/08* (2013.01)

(58) Field of Classification Search
CPC ... H01P 5/16; H01P 5/18; H01P 5/184–5/187
USPC ..... 333/109, 112, 116, 238
See application file for complete search history.

(56) References Cited

U.S. PATENT DOCUMENTS 4,591,812 A * 5/1986 Stegens ..... H01P 5/185 333/116
6,346,863 B2 * 2/2002 Sasaki et al. ..... 333/116
6,771,141 B2 * 8/2004 Iida et al. ..... 333/116
6,859,177 B2 * 2/2005 Pozdeev ..... 343/700 MS
7,009,467 B2 * 3/2006 Sawicki ..... 333/116
7,414,493 B1 * 8/2008 Hussain et al. ..... 333/116
7,446,626 B2 11/2008 Gorbachov
7,564,325 B2 7/2009 Hussain et al.
7,567,147 B2 * 7/2009 Toujo et al. ..... 333/116
7,714,679 B2 * 5/2010 Jiang ..... H01P 5/185 333/116
8,258,889 B2 * 9/2012 Fluhrer ..... 333/116

(Continued)

OTHER PUBLICATIONS

Sawicki et al., "Novel-Coupled Line Conductor-Backed Coplanar and Microstrip Directional Couplers for PCB and LTCC Applications", IEEE Transactions on Microwave Theory and Techniques, vol. 51, No. 6, Jun. 2003, pp. 1743-1751.

(Continued)

*Primary Examiner* — Dean Takaoka

(74) *Attorney, Agent, or Firm* — Kelley Drye & Warren LLP

(57) ABSTRACT

An RF coupler implementable as an integrated circuit includes a first transmission line having a first line portion and a second line portion. A first end of the first transmission line is coupled to an input port for receiving an RF input signal. A second end of the first transmission line is coupled to an output port for providing an RF output signal. The RF coupler further includes a second transmission line formed between the first line portion and the second line portion such that magnetic field produced due to the RF input signal in the first line portion and the second line portion envelops the second transmission line. A first end of the second transmission line is configured as a coupled port for providing a coupled RF signal, and a second end of the second transmission line is coupled to a termination element to form an isolation port.

13 Claims, 9 Drawing Sheets

(56) References Cited

U.S. PATENT DOCUMENTS

| | | | | |
|---|---|---|---|---|
| 8,330,552 | B2 * | 12/2012 | Li et al. | 333/116 |
| 2010/0134201 | A1 * | 6/2010 | Fluhrer | H01P 5/184 333/116 |
| 2011/0128091 | A1 * | 6/2011 | Fujiwara et al. | 333/112 |
| 2011/0267194 | A1 * | 11/2011 | Hong et al. | 340/572.7 |
| 2011/0316646 | A1 * | 12/2011 | Li | H01P 5/187 333/116 |
| 2012/0306589 | A1 * | 12/2012 | Mukaiyama | 333/112 |

OTHER PUBLICATIONS

Emery et al., "Analysis and Design of Ideal Non Symetrical Coupled Microstrip Directional Couplers", IEEE Microwave Theory and Techniques Symposium Digest, 1989, vol. 1, Paper K5, pp. 329-332.

Dydyk, Michael, "Microstrip Directional Couplers with Ideal Performance via Single Element Compensation", IEEE Transactions on Microwave Theory and Techniques, vol. 47, No. 6, Jun. 1999, pp. 956-964.

* cited by examiner

RADIO FREQUENCY (RF) COUPLERS

CROSS REFERENCE TO RELATED APPLICATIONS

This application claims priority from U.S. provisional application No. 61/701,168 titled: "Miniature Directional Couplers" filed on Sep. 14, 2012, the disclosure of which is hereby incorporated by reference.

FIELD OF THE INVENTION

The present invention relates, in general, to Radio Frequency (RF) communication systems. More specifically, the present invention relates to an RF coupler utilizable in the RF communication systems and particularly to an RF coupler implementable as a component of an integrated circuit (IC).

BACKGROUND OF THE INVENTION

In recent years, RF communication systems have emerged as one of the major means of communicating data/messages from a first location to a second location. These days, the RF communication systems are being used in various fields such as, but not limited to, mobile communications system, Wi-Fi communication system, Bluetooth, and Wi-Max.

A typical RF communication system includes a data source, an encoder, a modulator, and an antenna. The data/messages to be transmitted originate from the data source. Thereafter, the encoder encodes the data/messages. The modulator modulates the encoded data/messages on an RF carrier signal. This RF carrier signal is then transmitted to the second location using the antenna. In certain scenarios, there may be a need to transmit the RF carrier signal to other components in the RF communication system (e.g., an RF power sensor) in addition to the transmission of the RF signal to the antenna. In such a case, an RF coupler is used to divide the power of the RF carrier signal into two (or more) portions such that the first portion of the power is supplied to the antenna and the second portion of the power is supplied to other components in the RF communication system.

FIG. 1 is a schematic diagram of a conventional RF coupler 100 in accordance with an embodiment. Conventional RF coupler 100 includes a first transmission line 102, a second transmission line 104, an input port 106, an output port 108, a coupled port 110, and an isolation port 112.

A first end and a second end, of first transmission line 102 are input port 106 and output port 108 respectively. A first end and a second end, of second transmission line 104 are coupled port 110 and isolation port 112 respectively. First transmission line 102 and second transmission line 104 are fabricated in close proximity of each other such that first transmission line 102 electromagnetically couples with second transmission line 104. Due to this, there exists a mutual inductance and a mutual capacitance between first transmission line 102 and second transmission line 104.

In operation, a first RF signal is applied to input port 106. Due to the mutual inductance and the mutual capacitance between first transmission line 102 and second transmission line 104, a portion of the first RF signal is induced in second transmission line 104 (hereinafter referred as the second RF signal). The second RF signal traverses through second transmission line 104. Further, the second RF signal is obtained from coupled port 110. The remaining portion of the first RF signal traverses through first transmission line 102 and is obtained from output port 108.

Conventional RF coupler 100 incurs losses due to the induction of the second RF signal in second transmission line 104. Examples of such losses include insertion losses (i.e., ratio of power of the RF signal at output port 108 to power of the RF signal at input port 106), coupling losses (i.e., ratio of power of the RF signal at coupled port 110 to power of the RF signal at input port 106), dielectric losses, conductor losses, etc. Accordingly, there is a need for an invention that reduces such losses in RF couplers.

SUMMARY OF THE INVENTION

According to embodiments illustrated there is provided a Radio Frequency (RF) coupler including a first transmission line having a first line portion and a second line portion. A first end of the first transmission line is coupled to an input port for receiving an RF input signal. A second end of the first transmission line is coupled to an output port for providing an RF output signal. The RF coupler further includes a second transmission line formed between the first line portion and the second line portion such that magnetic field produced due to the RF input signal in the first line portion and the second line portion envelops the second transmission line. A first end of the second transmission line is configured as a coupled port for providing a coupled RF signal. A second end of the second transmission line is coupled to a termination element to form an isolation port.

According of embodiments illustrated there is provided a Radio Frequency (RF) coupler including a first transmission line having a first line portion and a second line portion. A first end of the first transmission line is configured as an input port for receiving an RF input signal, while a second end of the first transmission line is configured as an output port for providing an RF output signal. Further, the RF coupler includes a plurality of second transmission lines formed between the first line portion and the second line portion such that magnetic field produced due to the RF input signal in the first line portion and the second line portion envelops the plurality of second transmission lines. A first end of each of the plurality of second transmission lines is configured as a coupled port for providing a coupled RF signal. A second end of each of the plurality of second transmission lines is connected to a termination element to form an isolation port.

As the magnetic field produced due to the RF signal in the first line portion and the second line portion of the first transmission line envelops the second transmission line, coupling between the first transmission line and the second transmission line increases. This allows a desired degree of coupling to be achieved with a shorter length of transmission line. Since shorter transmission lines are used in the directional couplers, overall losses in the RF coupler such as the insertion losses of the first transmission line and second transmission line are reduced. Further, as the second transmission line is disposed in the gap between the first line portion and the second line portion, the area occupied by the RF coupler is less in comparison to area required by the conventional RF coupler.

BRIEF DESCRIPTION OF DRAWINGS

The following detailed description of the embodiments of the present invention will be better understood when read in conjunction with the appended drawings. The present invention is illustrated by way of example, and not limited by the accompanying figures, in which like references indicate similar elements.

DETAILED DESCRIPTION OF THE PREFERRED EMBODIMENTS

The detailed description of the appended drawings is intended as a description of certain of the embodiments of the present disclosure, and is not intended to represent the only form in which the present invention may be practiced. It is to be understood that the same or equivalent functions may be accomplished by different embodiments that are intended to be encompassed within the spirit and scope of the present disclosure.

The present invention is directed to an RF coupler that improves the coupling between a first transmission line (hereinafter referred to as a through line) and a second transmission line (hereinafter referred to as a coupled line) in the RF coupler. The through line is divided into a first line portion and a second line portion. The coupled line is formed between the first line portion and the second line portion. Since the coupled line is formed between the portions of the through line (i.e., the first portion and the second portion), coupling between the through line and the coupled line is better in comparison to the conventional RF couplers. In addition, the improved RF coupler occupies less space in comparison to the conventional RF couplers.

Figure 1:
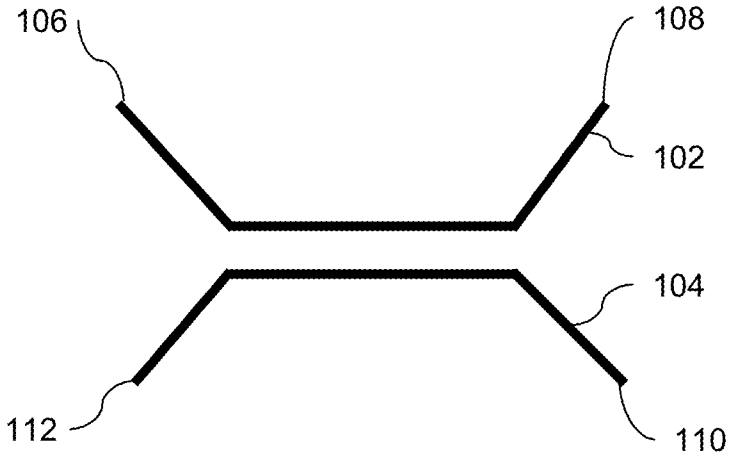
FIG. 1 (Prior Art)
FIG. 1 is a layout diagram of a conventional RF coupler.
Figure 2:
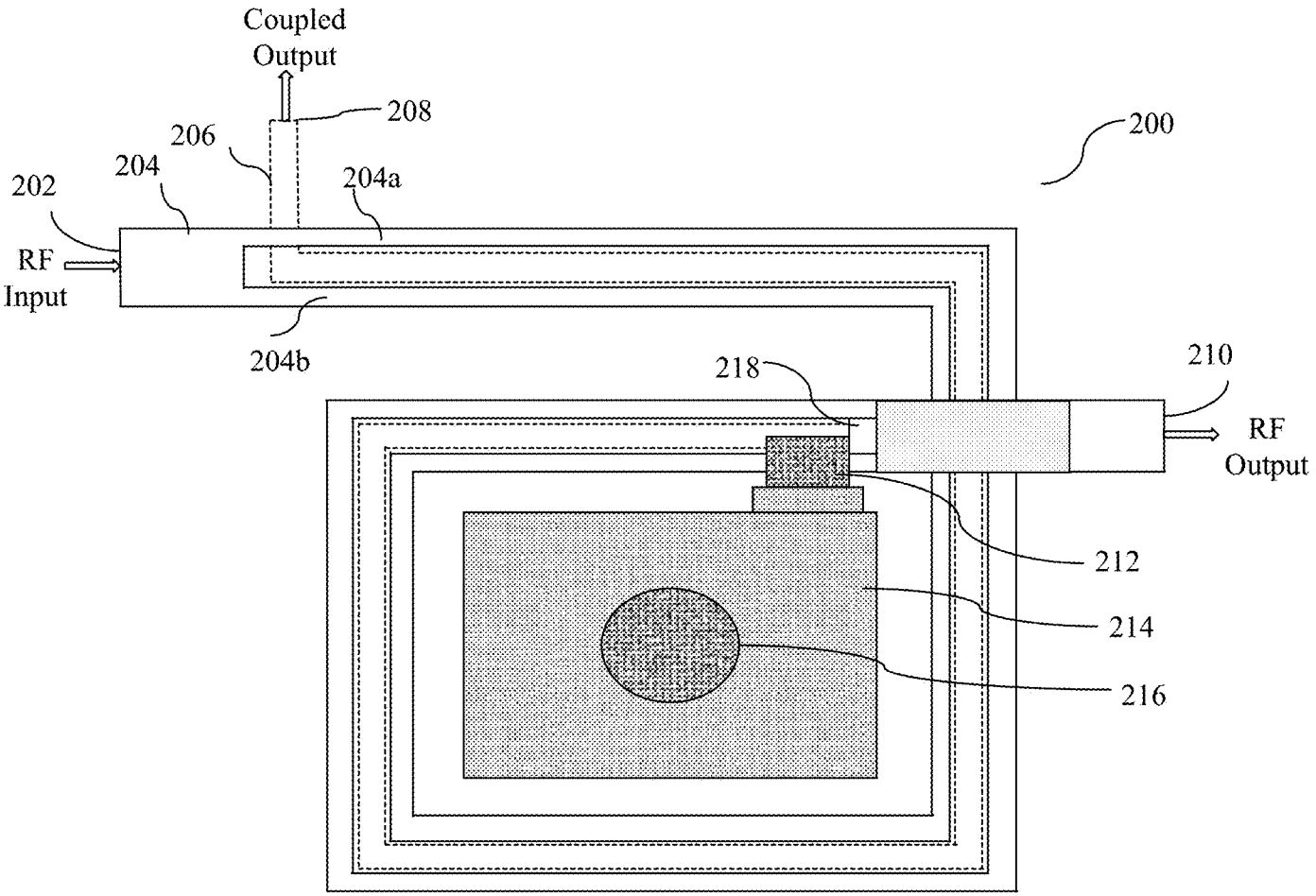
FIG. 2 is a layout diagram of an RF coupler, in accordance with an embodiment of the invention.

FIG. 2 is a schematic diagram of an RF coupler 200, in accordance with an embodiment of the invention. RF coupler 200 includes an input port 202, a through line 204, a coupled line 206 (depicted by dotted lines), a coupled port 208, an output port 210, a termination element 212, a via contact pad 214, a via 216, and an isolation port 218.

Through line 204 is coupled to input port 202. Further, through line 204 is divided into a first line portion 204*a* and a second line portion 204*b*. First line portion 204*a* and second line portion 204*b* extend spirally inward around via contact pad 214 to connect to output port 210. In an embodiment implemented as an integrated circuit, first line portion 204*a* and second line portion 204*b* are spaced apart at a predetermined distance of 16 um. Coupled line 206 is formed in the space between first line portion 204*a* and second line portion 204*b*. In an embodiment, coupled line 206 is formed at a distance of 3 μm from both, first line portion 204*a* and second line portion 204*b*. Since coupled line 206 is formed in close proximity to first line portion 204*a* and second line portion 204*b*, there exists a mutual inductance and a mutual capacitance between through line 204 and coupled line 206. Further, coupled line 206 extends spirally inward, along with first line portion 204*a* and second line portion 204*b*, to connect to termination element 212. Termination element 212 is coupled to via 216 through via contact pad 214. Further, termination element 212 is coupled to isolation port 218, at one end of coupled line 206. Via 216 is connected to a ground terminal (not shown). The second end of coupled line 206 is connected to coupled port 208.

Figure 4:
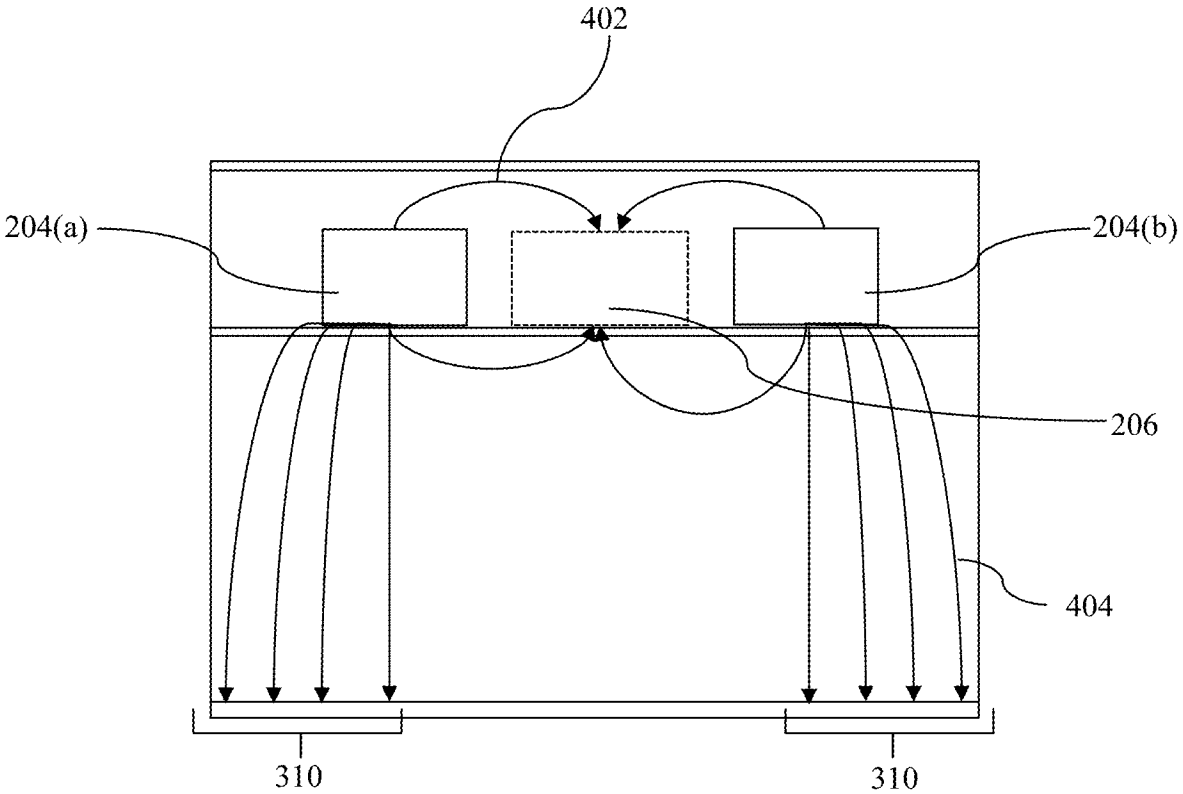
FIG. 4 is a cross-sectional diagram of RF coupler depicting the electric field lines, in accordance with an embodiment of the invention.
Figure 5:
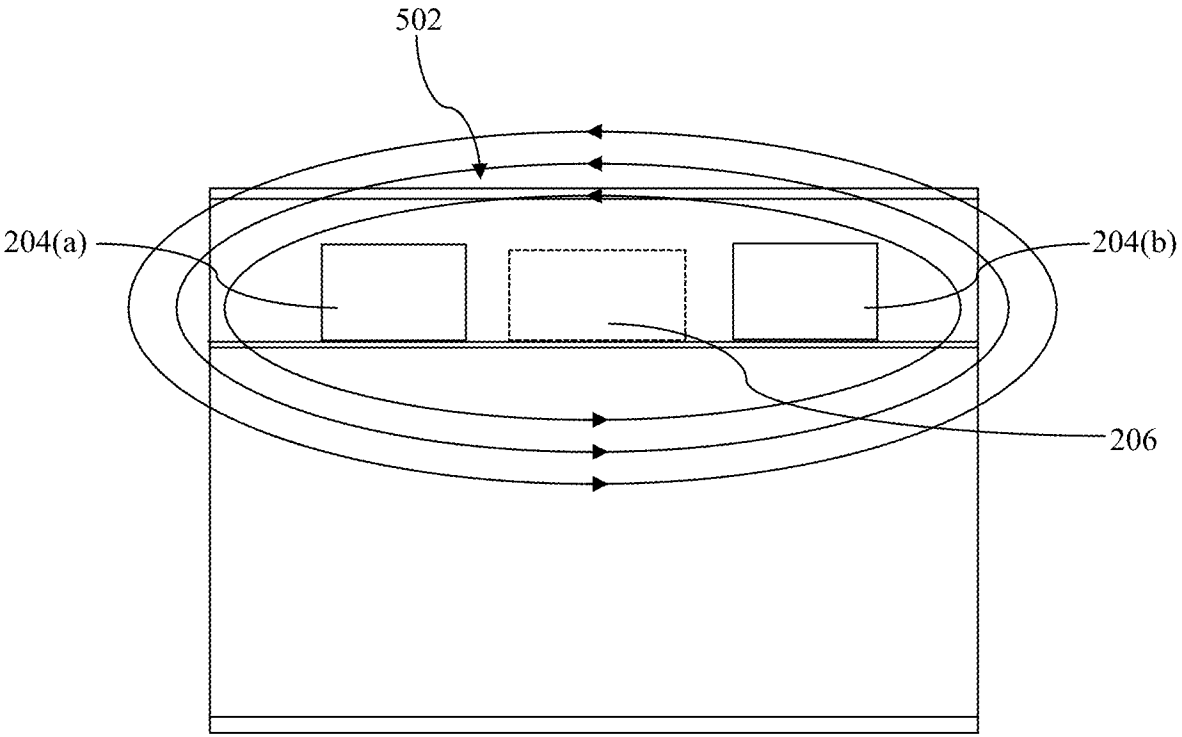
FIG. 5 is a cross-sectional diagram of RF coupler depicting the magnetic field lines, in accordance with an embodiment of the invention.

In operation, through line 204 receives an RF signal through input port 202. As through line 204 is divided into first line portion 204*a* and second line portion 204*b*, both first line portion 204*a* and second line portion 204*b* carry the RF signal to output port 210. Since coupled line 206 is formed in close proximity to first line portion 204*a* and second line portion 204*b* (e.g., 3 μm gaps), a fraction of the RF signal flowing through first line portion 204*a* and second line portion 204*b* gets induced in coupled line 206. Hereinafter, the induced RF signal is referred as the coupled RF signal. The coupled RF signal is obtained from coupled port 208. Further, the coupled RF signal is isolated from via contact pad 214 by termination element 212. Due to the flow of the RF signal in first line portion 204*a* and second line portion 204*b*, magnetic fields and electric fields are generated. In an embodiment, the magnetic field between through line 204 and coupled line 206 provides the mutual inductance between through line 204 and coupled line 206. Similarly, the electric field between through line 204 and coupled line 206 provides the mutual capacitance between through line 204 and coupled line 206. The configurations of the electric field lines and the magnetic field lines produced due to the flow of the RF signal and the coupled RF signal are illustrated in FIG. 4 and FIG. 5 respectively and will be described later.

The ratio of the power of the coupled RF signal at isolation port 218 to the power of the coupled RF signal at coupled port 208 is a measure of directivity of RF coupler 200. Following equation is a mathematical formation of the directivity of RF coupler 200:

$$\text{Directivity}=10\log(P_3/P_4) \tag{1}$$

Where, $P_4$: Power output of the coupled RF signal at isolation port 218; and $P_3$: Power output of the coupled RF signal at coupled port 208.

In order to maximize the directivity, the power of the coupled RF signal at isolation port 218 should be minimum. In order to minimize the power at isolation port 218, the impedance of termination element 212 should provide a match to the input impedance of RF coupler 200. The following equation illustrates a mathematical formulation to determine the impedance of termination element 212:

$$Z_{term}=L_m/(C_m*Z_o) \tag{2}$$

Where, $Z_{term}$: Impedance of termination element 212;

$L_m$: Mutual inductance between through line 204 and coupled line 206;

$C_m$: Mutual capacitance between through line 204 and coupled line 206; and $Z_o$: Input impedance of RF coupler 200.

In an embodiment, termination element 212 is a resistive element. A person of ordinary skill in the art would understand the scope of the disclosure should be limited to termination element 212 as a resistive element. In an embodiment, termination element 212 corresponds to at least one of a capacitive element, or inductive element. In another embodiment, termination element 212 may correspond an active device such as a transistor that may allow a control signal to maximize directivity of RF coupler 200 under dynamic load pull conditions.

Figure 3A:
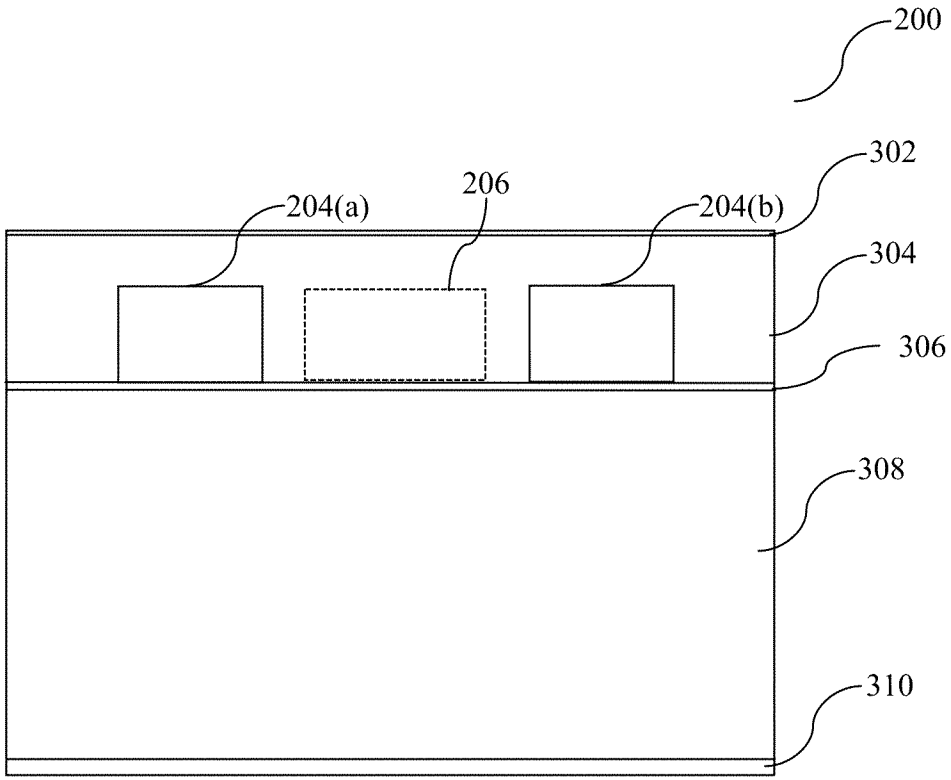
FIG. 3*a* and FIG. 3*b*, is a cross-sectional diagram of RF coupler, in accordance with an embodiment of the invention.
Figure 3B:
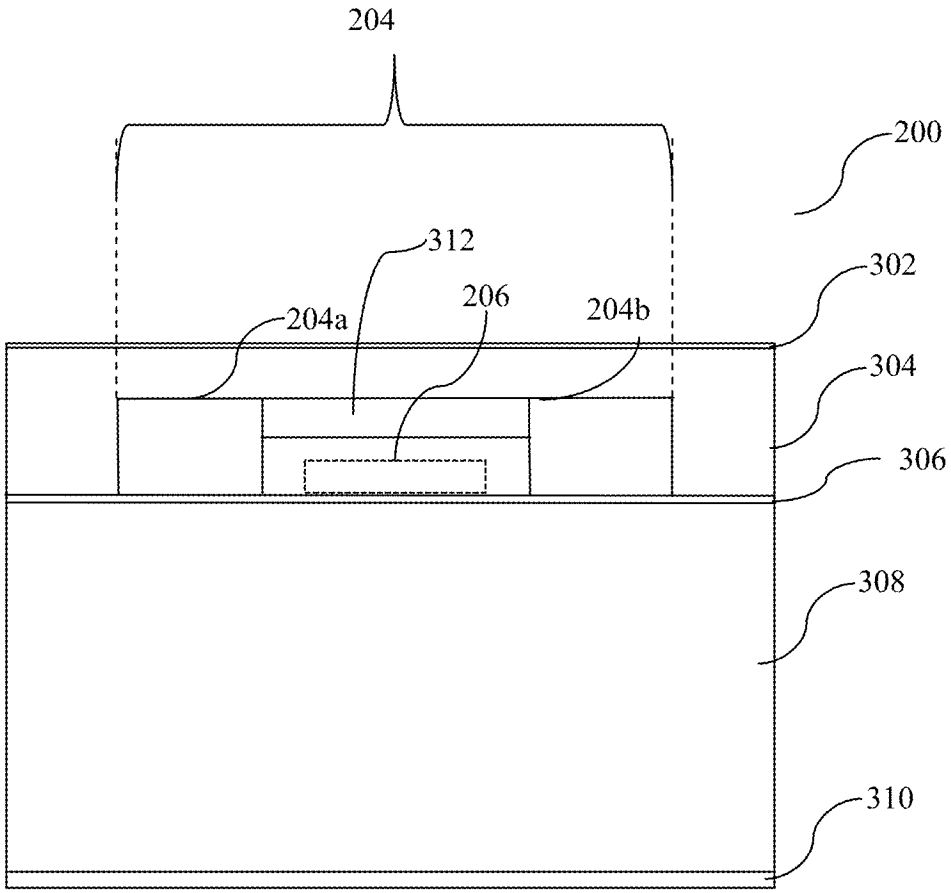

FIG. 3*a* and FIG. 3*b* is a cross-sectional diagram of RF coupler 200, in accordance with an embodiment of the invention. FIG. 3 has been described in conjunction with FIG. 2.

Referring to FIG. 3*a*, RF coupler 200 is composed of a passivation layer dielectric 302, an inter-layer dielectric 304, an insulator layer 306, a substrate layer 308, and a ground layer 310. Inter-layer dielectric 304 acts as a dielectric between first line portion 204*a*, coupled line 206, and second line portion 204*b*. In an exemplary embodiment, inter-layer dielectric 304 is composed of Benzocyclobutene (BCB). In an embodiment, first line portion 204*a*, second line portion 204*b*, and coupled line 206 are flat strips of metal conductors that are used for carrying the RF signals. Insulator layer 306 separates coupled line 206, first line portion 204*a*, and second line portion 204*b* from substrate layer 308. In an embodiment, passivation layer dielectric 302 and Insulator layer 306 are composed of Silicon Nitride. In an embodiment, substrate layer 308 is composed of Gallium Arsenide, which is backed with ground layer 310.

In an embodiment, first line portion 204*a* and second line portion 204*b* are connected on the top side such that coupled line 206 is enclosed by through line 204 on the top side. Referring to FIG. 3*b*, first line portion 204*a* and second line portion 204*b* are connected with each other on the top side by a metal conductor, depicted by 312. In an embodiment, metal conductor 312 is composed of same material as used in first line portion 204*a* and second line portion 204*b*. Further, first line portion 204*a*, second line portion 204*b*, and metal conductor 312 together form through line 204. Inter-layer dielectric 304 is the dielectric between through line 204 and coupled line 206. Further, Interlayer dielectric 304 is used to form termination element 212 between coupled line 206 and via contact pad 214. FIG. 4 is a cross-sectional diagram of RF coupler 200 depicting the electric field lines, in accordance with an embodiment of the invention. The RF signal and the coupled RF signal flowing in through line 204 and coupled line 206 respectively generate an electric field between through line 204 and coupled line 206. The electric field lines between through line 204 and coupled line 206 have been depicted by 402. In addition to the electric field between through line 204 and coupled line 206, there exists an electric field between the through line 204 and ground layer 310 (depicted by electric field line 404).

FIG. 5 is a cross-sectional diagram of RF coupler 200 depicting the magnetic field lines, in accordance with an embodiment of the invention. The RF signal flowing through first line portion 204*a* and second line portion 204*b* generates the magnetic field. The resultant magnetic field produced due the RF signal in first line portion 204*a* and second line portion 204*b*, envelops coupled line 206. From FIG. 5 it can be observed that magnetic field lines 502 envelop first line portion 204*a*, second line portion 204*b*, and coupled line 206. Due to this, the coupling between through line 204 and coupled line 206 increases. As the coupling between through line 204 and coupled line 206 increases, less transmission line length is needed to achieve a desired degree of coupling, therefore the overall losses in RF coupler 200 are reduced.

Figure 6A:
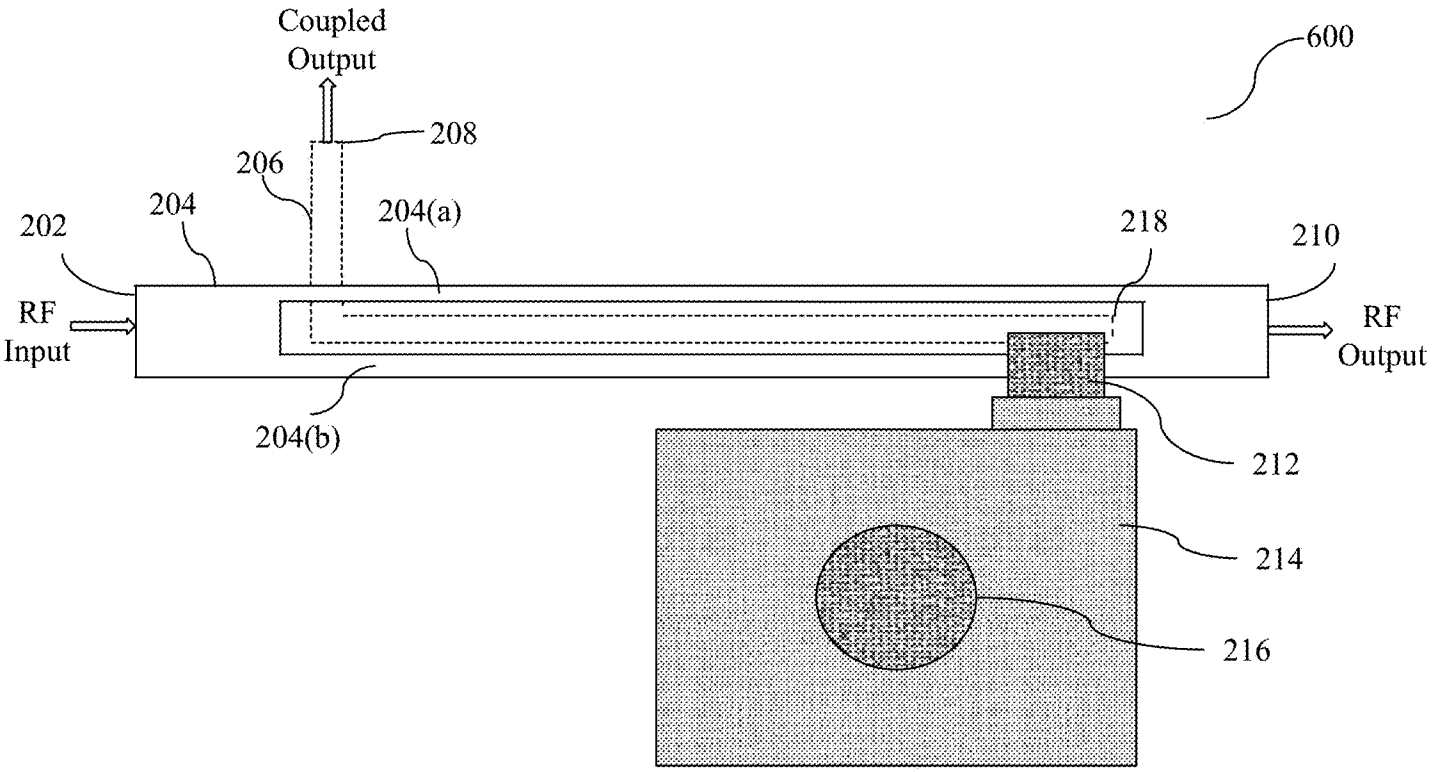
FIG. 6*a* and FIG. 6*b* are schematic diagrams of an RF coupler, in accordance with an embodiment of the invention.
Figure 6B:
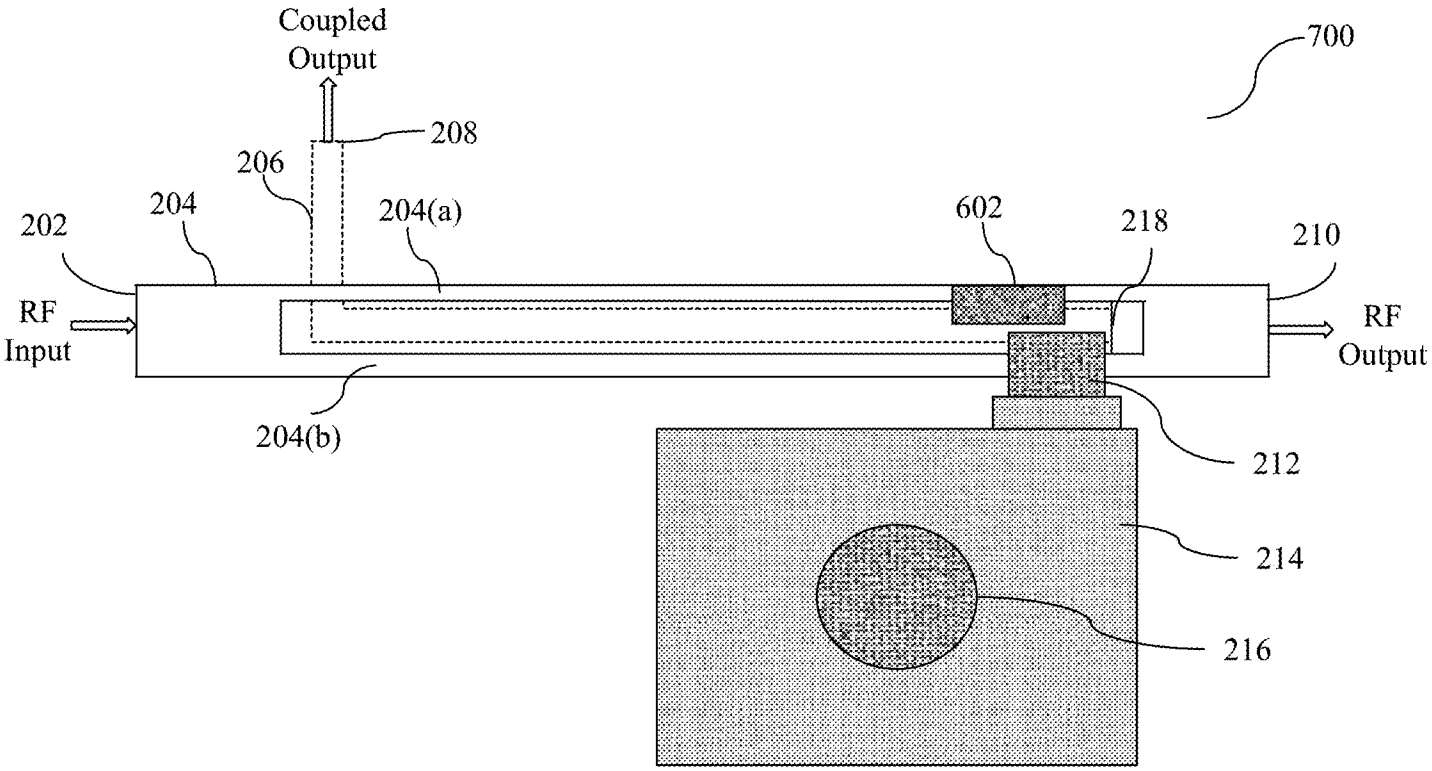

FIG. 6*a* and FIG. 6*b* are schematic diagrams of an RF coupler 600, in accordance with an embodiment of the invention. RF coupler 600 includes input port 202, through line 204, coupled line 206, coupled port 208, output port 210, termination element 212, via contact pad 214, via 216, isolation port 218, and a capacitive element 602.

RF coupler 600 is similar to RF coupler 200 in terms of the placement of through line 204 and coupled line 206. In RF coupler 600, through line 204 extends in a straight line to connect to output port 210. Further, coupled line 206 extends in the straight line along with through line 204 to connect to termination element 212. Since the length of through line 204 and coupled line 206 in RF coupler 600 is shorter in comparison to length of through line 204 and coupled line 206 in RF coupler 200, the magnitudes of the mutual inductance and the mutual capacitance in RF coupler 600 are smaller in comparison to the mutual inductance and the mutual capacitance in RF coupler 200. This makes RF coupler 600 suitable for higher frequency operation than RF coupler 200 at the same degree of coupling. In an embodiment, in order to operate RF coupler 600 at low frequencies, capacitive element 602 is connected between first line portion 204*a* of through line 204 and coupled line 206 (see FIG. 6*b*). In an embodiment, capacitive element 602 is a Metal-Insulator-Metal (MIM) capacitor.

A person having ordinary skill in the art will understand that the scope of the invention should not be limited to having a single coupled line 206 formed in the space between first line portion 204*a* and second line portion 204*b*. In an embodiment, a plurality of coupled lines can also be formed in the space between first line portion 204*a* and second line portion 204*b*. RF coupler with the plurality of coupled lines has been depicted in FIG. 7. This configuration is useful when a system requires more than one coupled signal.

Figure 7:
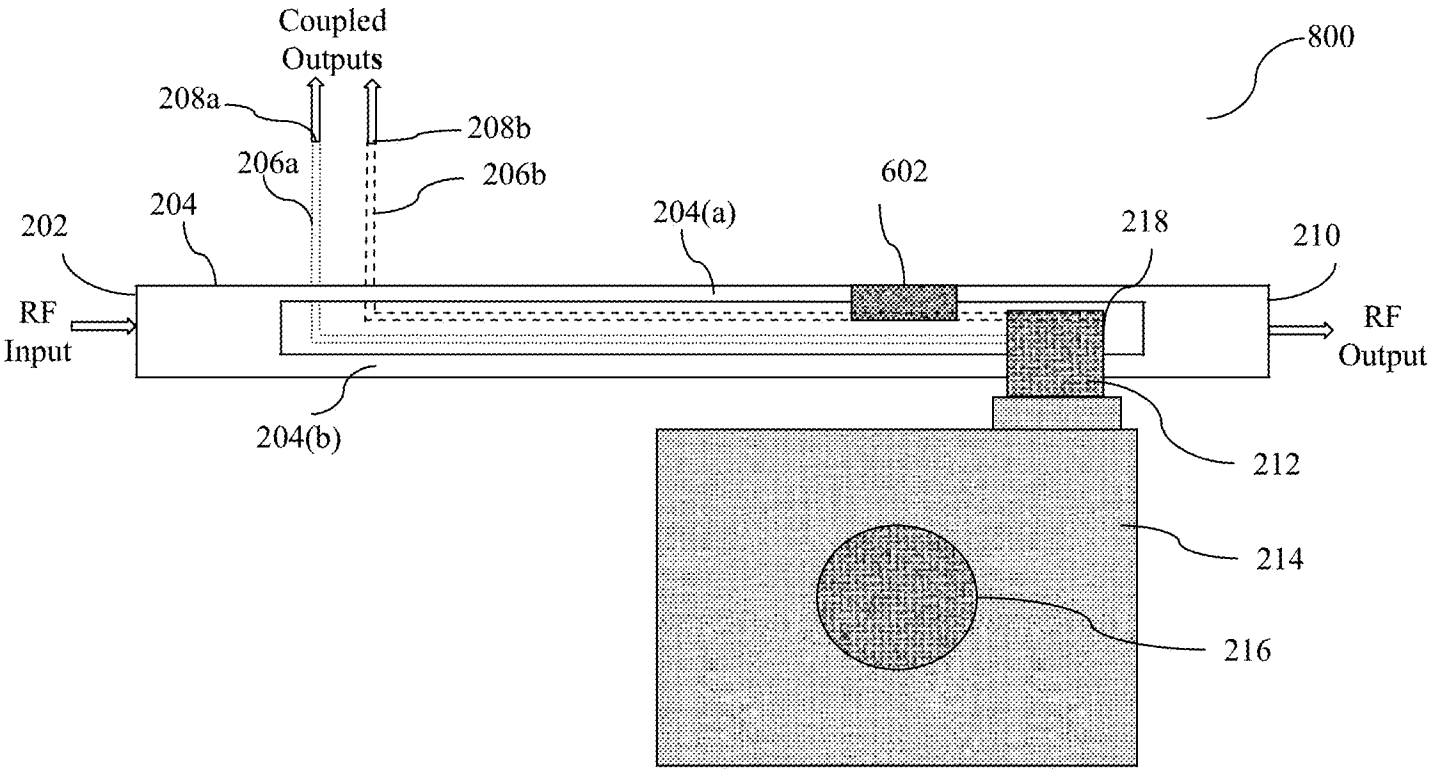
FIG. 7 is yet another layout diagram of RF coupler, in accordance with an embodiment of the invention.

FIG. 7 is yet another layout diagram of an RF coupler 700, in accordance with an another embodiment of the invention. RF coupler 700 includes input port 202, through line 204, a first coupled line 206*a* (shown with dotted lines), a second coupled line 206*b* (shown with dashed lines), coupled ports 208*a* and 208*b*, output port 210, termination element 212, via contact pad 214, via 216, isolation port 218, and capacitive element 602.

RF coupler 700 is similar to RF coupler 600 in terms of overall layout. However, RF coupler 700 includes multiple coupled lines (i.e., first coupled line 206*a* and second coupled line 206*b*). First coupled line 206*a* and second coupled line 206*b* are coupled to isolation port 218 through termination element 212. Further, first coupled line 206*a* and second coupled line 206*b* are coupled to coupled ports 208*a* and 208*b*. The RF signal coupled in first coupled line 206*a* and second coupled line 206*b* is obtained from coupled ports 208*a* and 208*b*.

The disclosed embodiments encompass numerous advantages. Through line 204 is divided into two portions, i.e., first line portion 204*a* and second line portion 204*b*. First line portion 204*a* and second line portion 204*b* are placed at a distance from each other. Coupled line 206 is formed in the space between first line portion 204*a* and second line portion 204*b*. Since coupled line 206 is disposed between first line portion 204*a* and second line portion 204*b*, the size of the RF coupler is smaller in comparison to a conventional RF coupler. Further, as the magnetic field generated due to an RF signal in first line portion 204*a* and second line portion 204*b* encompasses coupled line 206, the coupling between through line 204 and coupled line 206 increases. The increase in coupling between through line 204 and coupled line 206 allows a shorter length of transmission line to be used for a given degree of coupling which reduces the losses in the RF coupler.

While the various embodiments of the invention have been illustrated and described, it will be clear that the invention is not limited only to these embodiments. Numerous modifications, changes, variations, substitutions, and equivalents will be apparent to those skilled in the art, without departing from the spirit and scope of the invention.

What is claimed is:

1. A Radio Frequency (RF) coupler comprising:

a first transmission line having a first line portion and a second line portion connected in parallel, a first end of the first transmission line coupled to an input port for receiving an RF input signal, a second end of the first transmission line coupled to an output port for providing an RF output signal; and a second transmission line located between the first line portion and the second line portion such that magnetic field produced due to the RF input signal in the first line portion and the second line portion envelops the second transmission line, the second transmission line being located at a predefined gap from the first line portion and the second line portion respectively, a first end of the second transmission line being configured as a coupled port for providing a coupled RF signal, a second end of the second transmission line being coupled to a termination element to form an isolation port; and an inter-layer dielectric (ILD) formed in a cross-over intersection between the first transmission line and the second transmission line, the inter-layer dielectric being further utilizable to form the termination element between the second transmission line and a via contact pad.

2. The RF coupler of claim 1, wherein the magnetic field enveloping the second transmission line provides a mutual inductance between the first transmission line and the second transmission line.

3. The RF coupler of claim 1, wherein the predefined gap between the second transmission line, the first line portion and the second line portion creates a mutual capacitance between the first transmission line and the second transmission line.

4. The RF coupler of claim 1, wherein the first transmission line and the second transmission line extend in a spiral to connect the input port to the output port and the coupled port to the isolation port respectively.

5. The RF coupler of claim 1, wherein the first transmission line and the second transmission line extend in a straight line to connect the input port to the output port and the coupled port to the isolation port respectively.

6. The RF coupler of claim 5, further comprising a capacitor connected to the first transmission line and the second transmission line.

7. The RF coupler of claim 6, wherein the capacitor is a Metal-Insulator-Metal (MIM) capacitor.

8. The RF coupler of claim 1, wherein one or more second transmission lines are formed between the first line portion and the second line portion of the first transmission line.

9. The RF coupler of claim 1, wherein the termination element is a termination resistor.

10. The RF coupler of claim 1, where the impedance of the termination element matches with the impedance of the input port.

11. The RF coupler of claim 1, implemented as an integrated circuit.

12. A Radio Frequency (RF) coupler comprising:

a first transmission line having a first line portion and a second line portion, a first end of the first transmission line being configured as an input port for receiving an RF input signal, a second end of the first transmission line being configured as an output port for providing an RF output signal; and a plurality of second transmission lines formed between the first line portion and the second line portion such that magnetic field produced due to the RF input signal in the first line portion and the second line portion envelops the plurality of second transmission lines, a first end of each of the plurality of second transmission lines being configured as a coupled port for providing a coupled RF signal, a second end of each of the plurality of second transmission line being coupled to a termination element to form an isolation port.

13. The RF coupler of claim 12, constructed as a component of an integrated circuit.

* * * * *